US006493523B2

(12) United States Patent
Weaver

(10) Patent No.: US 6,493,523 B2
(45) Date of Patent: Dec. 10, 2002

(54) CAPACITANCE AND RESISTANCE MONITOR FOR IMAGE PRODUCING DEVICE

(75) Inventor: Jeffrey S. Weaver, Fort Collins, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/854,320

(22) Filed: May 11, 2001

(65) Prior Publication Data

US 2002/0168193 A1 Nov. 14, 2002

(51) Int. Cl.[7] ..... G03G 15/00
(52) U.S. Cl. ..... 399/45; 399/389; 324/663
(58) Field of Search ..... 399/45, 66, 389; 324/663, 676, 677, 678, 691, 710, 711

(56) References Cited

U.S. PATENT DOCUMENTS 3,715,656 A * 2/1973 Hyde et al. ..... 324/605
4,134,147 A * 1/1979 Watanabe ..... 361/235
4,610,530 A * 9/1986 Lehmbeck et al. ..... 399/45
4,791,353 A * 12/1988 Typpo ..... 324/667
5,274,334 A * 12/1993 Mills ..... 324/676
5,572,309 A * 11/1996 Nishio et al. ..... 399/388
5,608,506 A * 3/1997 Omoto ..... 399/315
5,682,575 A * 10/1997 Komori ..... 399/66
5,799,226 A * 8/1998 Shigata et al. ..... 399/309
6,111,594 A 8/2000 Jeong
6,157,793 A * 12/2000 Weaver et al. ..... 399/45
6,223,004 B1 * 4/2001 Kodama ..... 399/44

* cited by examiner

*Primary Examiner*—Robert Beatty

(57) ABSTRACT

An apparatus and a method for optimizing the quality of electrophotographic imaging based on the properties of the printing media are presented. In order to determine the properties of the printing media without interrupting the normal image transfer process, the present invention uses rollers as a part of a sensor. When the printing media lies between the rollers, the rollers and the printing media form an RC circuit. A pulse is applied to the RC circuit, the step response of which is periodically sampled. The samples may be obtained logarithmically in time. Based on the resultant response, a controller calculates the resistance and the capacitance of the printing media and adjusts imaging parameters, such as the transfer bias voltage, for optimal image transfer. The entire optimization process occurs between the time the printing media passes through the rollers and the time the imaging transfer is executed.

25 Claims, 7 Drawing Sheets

CAPACITANCE AND RESISTANCE MONITOR FOR IMAGE PRODUCING DEVICE

FIELD OF THE INVENTION

The present invention relates to electrophotographic devices such as laser printers, and in particular to the determination of media type by electrophotographic devices.

BACKGROUND OF THE INVENTION

Electrophotographic processes for forming images upon print media are well known in the art. Typically, these processes include an initial step of charging a photoreceptor which may be provided in the form of a drum or continuous belt having photoconductive material. Thereafter, an electrostatic latent image is produced on the photoreceptor by exposing the charged area of the photoreceptor to a light image or scanning the charged area with a laser beam. A light-emitting diode array may be used in producing the electrostatic latent image on the photoreceptor.

Particles of toner may be applied to the photoreceptor upon which the electrostatic latent image is disposed such that the toner particles are transferred to the electrostatic latent image. Thereafter, the toner particles are transferred from the photoreceptor to the print media. This process involving the transfer of toner particles unto the media is herein referred to as image transfer process. Frequently, a fusing process follows the image transfer process and fixes the toner particles on the print media. A subsequent process may include cleaning or restoring the photoreceptor in preparation for the next printing cycle.

Two imaging parameters greatly affect the final print quality of the toner image supplied to the media. These imaging parameters are the electric field applied to the media during the image transfer process and the heat energy applied during the fusing process. The electric field applied to the media and the heat energy transferred during the fusing process, in turn, are affected by basis weight and the water content of the print media. The basis weight and the water content manifest themselves as differences in dielectric thickness, heat capacity and thermal conductivity for a given print media in a particular environment.

The optimal value of the imaging parameters applied during the image transfer process depends on the resistance and the capacitance of the print media. However, most conventional electrophotographic devices use a predetermined set of imaging parameters during the image transfer process for all print media. The failure to customize the imaging parameters to the particular print media that is used can result in less than optimal image quality. The failure to customize the imaging parameters to the resistively of print media is especially likely to result in an aesthetically displeasing output because print media range widely in resistively. For example, paper and transparencies, which are both common print media, have resistibilities that may differ by approximately six orders of magnitude. As most transfer systems are designed to handle a predetermined design range of resistance (resistance is a function of resistively and the physical dimensions), setting the imaging parameters to optimize image transfer onto paper leads to less than optimal quality output on transparencies, and vice versa.

Therefore, an electrophotographic device and method that can determine electrical properties (e.g., capacitance and resistance of print media) to produce high quality images is needed.

SUMMARY OF THE INVENTION

The present invention includes an apparatus and a method for electrophotographic imaging devices to adjust the imaging parameters to the type of print media, thereby achieving optimal print quality for all print media. According to the present invention, a set of rollers in an electrophotographic imaging device is made of conductive material, insulated from the device chassis, and connected to a monitoring circuit. The monitoring circuit includes a pulse forming circuit connected to a first roller and a sensing circuit connected to a second roller. The pulse forming circuit includes a capacitor and thus, a RC circuit forms when the media is positioned between the rollers. The pulse forming circuit applies a pulse to the media, and the sensing circuit measures the step response of the RC circuit. Based on the measured step height and the slope of the response, the resistance and the capacitance of the print media can be calculated. The resistance and the capacitance is then used to determine the optimal value of imaging parameters, such as the transfer bias voltage.

The step response is determined by sampling the response voltages from the voltage sensing circuit and using the samples to calculate the resistance and the capacitance of the print media. The optimal imaging parameters are determined either by calculation or by accessing a look-up table that contains pre-derived optimal values. Imaging parameters are then adjusted to the determined optimal values. The optimization process takes place between the time the print media passes between the first and second rollers and the time imaging occurs. Although the measurement may be accomplished with the media in motion, taking the measurements with the media in a temporarily stationary state (e.g., for 120 ms) improves the accuracy of the result. Thus, the optimization process of the present invention not only facilitates implementation by using a set of rollers that transport the print media, but also provides a way to determine and apply the optimal imaging parameters while the print media is moving through the imaging device.

DESCRIPTION OF THE DRAWINGS

Preferred embodiments of the invention are described below with reference to the following accompanying drawings.

DETAILED DESCRIPTION OF THE INVENTION

Figure 1:
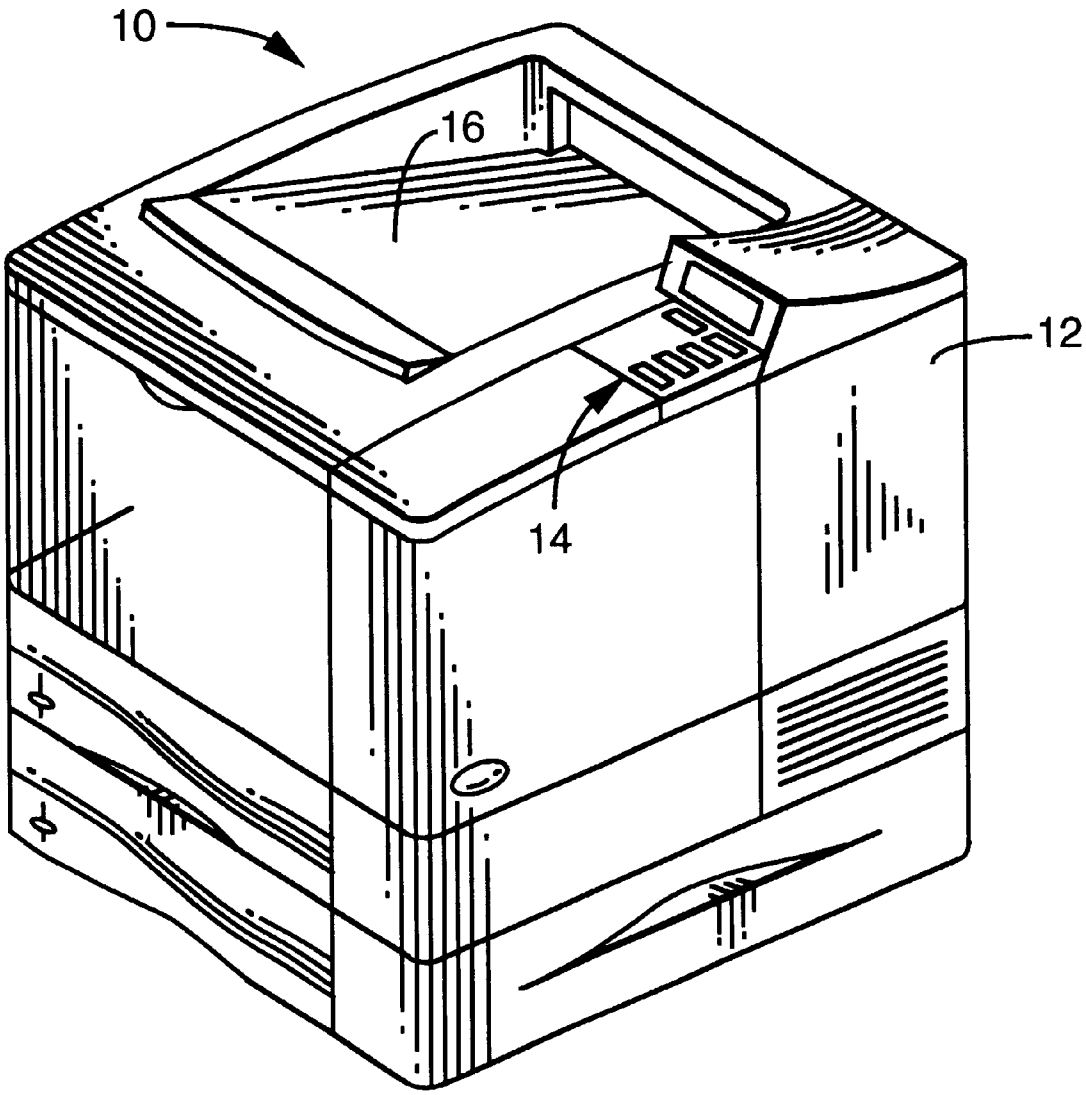
FIG. 1 depicts an electrophotographic device that can be used with the present invention.

FIG. 1 shows an exemplary electrophotographic device 10 embodying the present invention. The depicted electrophotographic device 10 comprises an electrostatographic printer, such as an electrophotographic or electrographic printer. In alternative embodiments, electrophotographic device 10 is provided in other configurations, such as facsimile or copier configurations.

The illustrated electrophotographic device 10 includes a housing 12 arranged to house internal components (not shown in FIG. 1). A user interface 14 is provided upon an upper surface of housing 12. User interface 14 includes a key pad and display in an exemplary configuration. A user can control operations of electrophotographic device 10 utilizing the key pad of user interface 14. In addition, the user can monitor operations of electrophotographic device 10 using the display of user interface 14. Outfeed tray 16 is also provided within the upper portion of housing 12. Outfeed tray 16 is arranged and positioned to receive outputted print media. Outfeed tray 16 provides storage for convenient removal of the print media from electrophotographic device 10. Exemplary print media include paper, transparencies, envelopes, etc.

Figure 2:
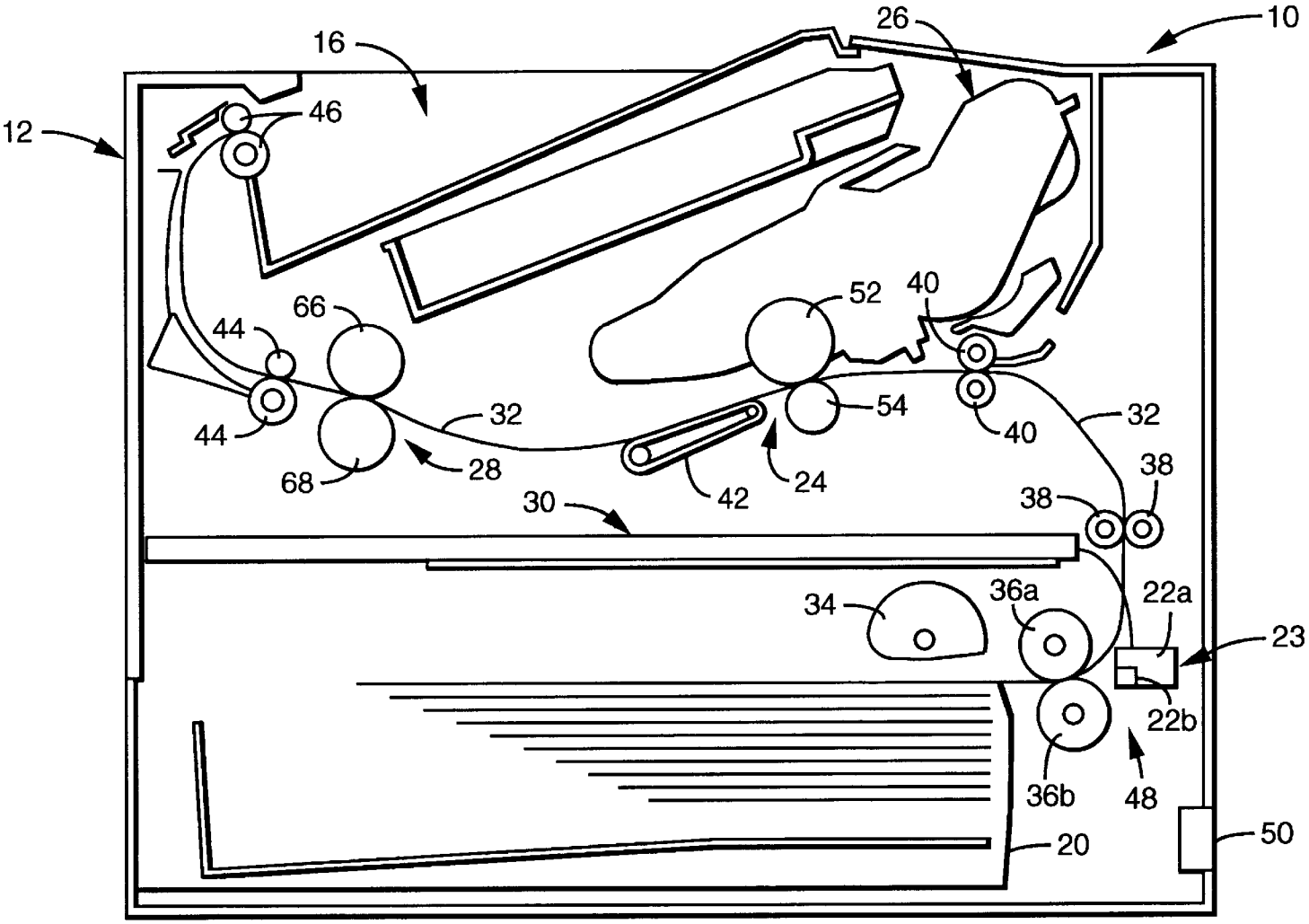
FIG. 2 depicts a cross-sectional view of the electrophotographic device of FIG. 1.

FIG. 2 shows various internal components of an exemplary configuration of electrophotographic device 10. The depicted electrophotographic device 10 includes media supply tray 20, imager 24, developing assembly 26, fuser 28, and controller 30. Media path 32 is provided through electrophotographic device 10. Plural rollers are provided along media path 32 to guide the print media in a downstream direction from media supply tray 20 towards outfeed tray 16. More specifically, FIG. 2 shows pick roller 34, squaring rollers 36, transport rollers 38, registration rollers 40, conveyor 42, delivery rollers 44, and output rollers 46 that guide the print media along media path 32. Squaring rollers 36*a* and 36*b* are connected to pulse forming circuit 22*a* and voltage sensing circuit 22*b*, respectively. Pulse forming circuit 22*a* and sensing circuit 22*b* make up monitoring circuit 23. The combination of squaring rollers 36 and monitoring circuit 23 is herein referred to as sensor 48.

Electrophotographic device 10 includes input device 50 configured to receive an image in the described printer configuration. An exemplary input device 50 includes a parallel connection coupled with an associated computer or network (not shown). Such a coupled computer or network could provide digital files (e.g., page description language (PDL) files) corresponding to an image to be produced within electrophotographic device 10.

Developing assembly 26 is positioned adjacent media path 32 and provides developing material, such as toner, for forming images. Developing assembly 26 is, e.g., implemented as a disposable cartridge for supplying such developing material.

Sensor 48 applies a voltage signal (e.g., a pulse) to the print when the print media is positioned between the rollers, and monitors the response of the media to the voltage signal. The applying of the voltage signal and the monitoring of the response may be accomplished when the print media is temporarily stopped, for example for 120 ms, between the rollers. Alternatively, the applying of the voltage signal and the monitoring of the response may be accomplished dynamically, while the print media is moving between the rollers. In accordance with the present invention, the resistance and the capacitance of the print media is calculated based on the response monitored by sensor 48. Additionally, sensor 48 can monitor physical dimensions such as the thickness of the print media. Further details on monitoring the physical thickness of a print media is provided in U.S. Pat. No. 6,157,793 to Jeffrey S. Weaver et al. entitled "Electrophotographic devices and Sensors Configured to Monitor Media, and Methods of Forming an Image Upon Media." U.S. Pat. No. 6,157,793 is herein incorporated by reference in its entirety.

Imager 24 is positioned adjacent media path 32 and deposits developing material 61 upon the print media to produce an image received via input device 50. Fuser 28 is adjacent to media path 32 and located downstream from imager 24 inside electrophotographic device 10. Fuser 28 fuses the developing material to the media.

Figure 3:
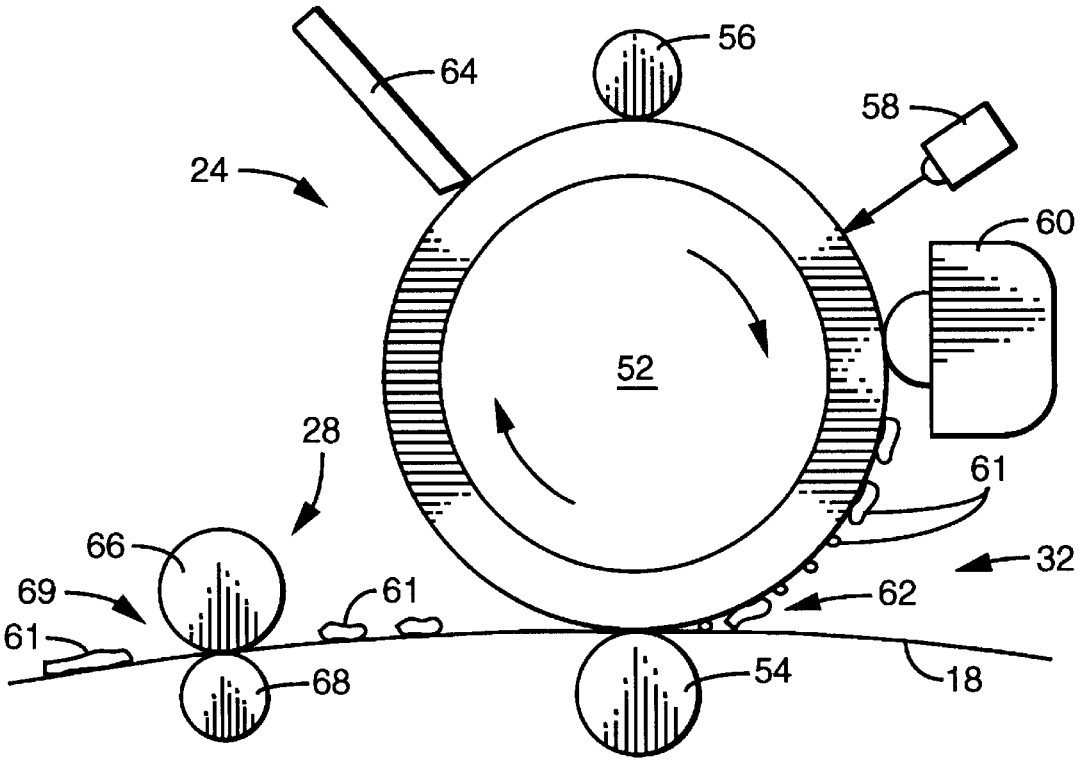
FIG. 3 depicts an imager and a fuser of the electrophotographic device.

FIG. 3 shows further details of the image transfer process that takes place in electrophotographic device 10. The depicted imager 24 includes an imaging roller 52 and transfer roller 54. Imaging roller 52 is a photoconductor which is insulative in the absence of incident light and conductive when illuminated. Imaging roller 52 may be implemented as a belt in an alternative configuration.

Imaging roller 52 rotates in a clockwise direction with reference to FIG. 3. The surface of rotating imaging roller 52 is charged uniformly by a charging device, such as charging roller 56. Charging roller 56 provides a negative charge upon the surface of imaging roller 52 in the described configuration. A laser device 58 scans across the charged surface of imaging roller 52 and writes an image to be formed by selectively discharging areas upon imaging roller 52 where toner is to be printed. Developer 60 applies developing material 61 adjacent imaging roller 52. Negatively-charged developing material 61 is attracted to discharged areas upon imaging roller 52 corresponding to the image and repelled from charged areas thereon.

Media sheet 18 traveling along media path 32 moves between imaging roller 52 and transfer roller 54 at transfer point 62 where media sheet 18 makes contact with imaging roller 52 and transfer roller 54. Media sheet 18 can comprise an individual sheet or one sheet of a continuous web. The developed image comprising the developing material is transferred to media sheet 18 at transfer point 62. A bias voltage is applied to transfer roller 54 and induces an electric field through media sheet 18. The magnitude of the induced field is determined by the bias voltage, the resistively of media sheet 18 and the dielectric thickness of media sheet 18. As described in detail below, an imaging parameter such as the bias voltage can be adjusted for the media type to provide optimal transfer of developing material 61.

The induced electric field causes developing material 61 to transfer from imaging roller 52 to media sheet 18. Residual developing material (not shown) on imaging roller 52 may be removed at cleaning station 64 to prepare imaging roller 52 for the the next image.

Media sheet 18 travels from imager 24 to fuser 28. Fuser 28 includes fusing roller 66 and pressure roller 68. Fusing roller 66 and pressure roller 68 are in contact at fusing point 69. Fusing roller 66 preferably includes an internal heating element to impart heat flux to developing material 61 upon media sheet 18 as well as media sheet 18 itself. Application of such heat flux from fusing roller 66 fuses developing material 61 cohesively to media sheet 18. Temperatures of fusing roller 66 for providing optimal fusing are dependent upon the properties of developing material 61, the velocity of media sheet 18, the surface finish of media sheet 18, and the thermal conductivity and heat capacity of media sheet 18. Control of fusing process responsive to media properties is described in detail in a U.S. patent application entitled "Electrophotographic devices, Fusing Assemblies and Methods of Forming an Image", filed on Jul. 6, 1999, naming Michael J. Martin, Nancy Cemusak, John Hoffman, Jeffrey S. Weaver, James G. Bearss and Thomas Camis as inventors, having Ser. No. 09/348,650, and incorporated herein by reference.

Figure 4:
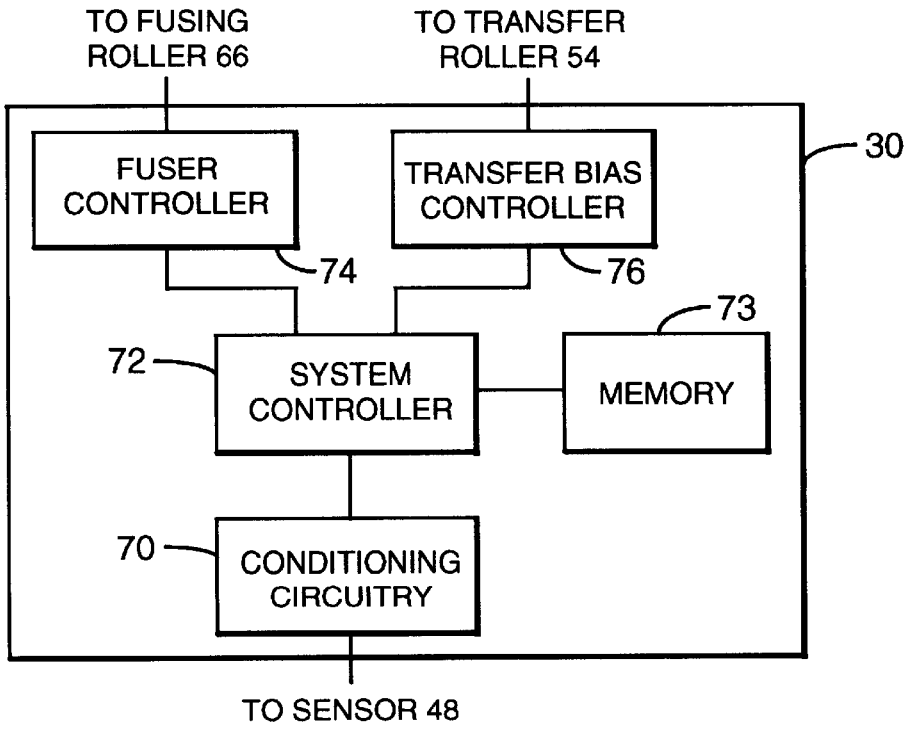
FIG. 4 depicts a functional block diagram of exemplary controller of the electrophotographic device.

FIG. 4 illustrates the components of controller 30. The exemplary embodiment of controller 30 includes conditioning circuitry 70, system controller 72, optimization unit 73 (which may be a memory), fuser controller 74 and transfer bias controller 76. In addition, controller 30 may also include other circuitry, such as analog power circuits (not shown). In the depicted arrangement, conditioning circuitry 70 is coupled with sensor 48, fuser controller 74 is coupled to fusing roller 66, and transfer bias controller 76 is coupled to transfer roller 54 (sensor 48, fusing roller 66 and transfer roller 54 are shown in FIG. 2). A number of processors can be used to build sensor 48. For example, Motorola 68HC08, which contains conditioning circuitry 70 and system controller 72, can be used. Alternatively, a processor that resides in printer 10, such as the processor of the formatter or the DC controller, may be used. The formatter converts the page description language into dots and sends the dots to the laser. The DC controller controls parts of printer 10 such as the paper feed, motors, and voltages.

System controller 72 comprises a digital microprocessor or micro-controller to implement print engine control operations in the described embodiment. System controller 72 is configured to execute a set of instructions provided as software or firmware of controller 30. Fuser controller 74 operates to control fusing roller 66 and transfer bias controller 76 operates to control transfer roller 54.

Transfer roller 54 operates to attract developing material 61 from imaging roller 52 to media sheet 18 according to an imaging parameter. An imaging parameter, such as the bias voltage, is applied to transfer roller 54. In accordance with the present invention, the imaging parameter may be adjusted to optimize the quality of image transfer for the type of media that is used.

In the embodiment described, sensor 48 is provided to monitor the response of print media to voltage signals. Although the present description discusses the signals as being voltage signals, a person of ordinary skill in the art would understand that any other type of signal that produces a measurable response by the media, such as a current signal, can be used. More specifically, sensor 48 is configured to determine or monitor qualitative and/or quantitative characteristics of the media and output a characteristic signal indicative of the qualitative and/or quantitative characteristics to controller 30 through conditioning circuitry 70. Controller 30 receives characteristic signals generated from sensor 48 and adjusts the imaging parameter of imager 24 responsive to the signals. In another embodiment, sensor 48 may also monitor ambient conditions (e.g., temperature, humidity, etc.) so that controller 30 may take the ambient conditions into account while adjusting the imaging parameter.

Conditioning circuitry 70 of controller 30 receives signals from sensor 48 and applies the conditioned signals to system controller 72. Exemplary conditioning circuitry 70 may include filtering circuitry that removes unwanted spikes or noise from the signal of sensor 48. The conditioning circuit may include, e.g., an analog-to-digital (A/D) converter or a buffer.

Optimization unit 73 of controller 30 may be a memory that stores a look-up table. The look-up table includes values which may be applied to fuser controller 74 and transfer bias controller 76 to control fusing and image transfer processes, respectively. System controller 72 indexes the look-up table stored within optimization unit 73 by properties of media sheet 18. The values in the look-up table may be empirically derived optimal imaging parameters for transfer bias controller 76. The optimal imaging parameters may have been calculated using media properties such as capacitance and resistance. Before media sheet 18 reaches imager 24, the look-up table is accessed based on the properties of media sheet 18 calculated from the signals of sensor 48. The short access time allows imaging parameters such as transfer bias to be adjusted and applied by the time the image transfer process takes place. Optimization unit 73 may include a processing unit that computes the optimal imaging parameters based on each set of capacitance and resistance.

System controller 72 accesses optimization unit 73, obtains the optimal imaging parameters, such as transfer bias voltage, and sends control signals to transfer bias controller 76. Transfer bias controller 76 then applies the required voltage to transfer roller 54 through controller 30. Thus, the imaging parameter (e.g., transfer bias voltage) of imager 24 is adjusted in response to the control signals received from controller 30.

Figure 5:
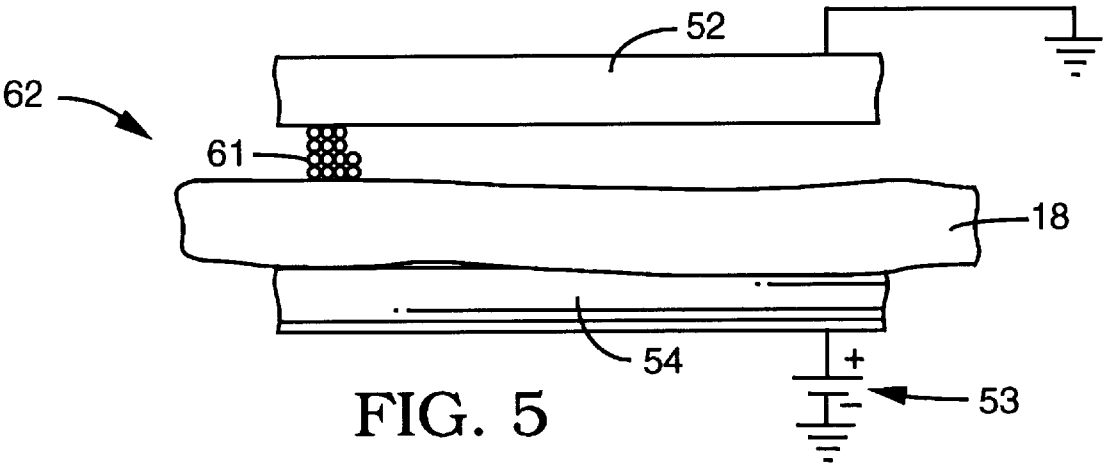
FIG. 5 depicts the transfer operations of the imager.

FIG. 5 shows the image transfer process which includes the transfer of developing material 61 from imaging roller 52 to media sheet 18 at transfer point 62. FIG. 5 shows media sheet 18 between imaging roller 52 and transfer roller 54 at transfer point 62. Imaging roller 52 is grounded to provide a reference voltage. Transfer roller 54 is coupled to positive voltage source 53, which may be included in controller 30 in some embodiments. Transfer bias controller 76 adjusts the voltage bias applied to transfer roller 54, thereby optimizing the transfer of developing material 61 based on the response signals from sensor 48.

An electrical field is generated between imaging roller 52 and transfer roller 54 due to the voltage potential between imaging roller 52 and transfer roller 54. The generated electrical field tends to attract developing material 61 from imaging roller 52 toward transfer roller 54 and upon media sheet 18 at transfer point of contact 62.

The optimal toner transfer fields generated at transfer point 62 are dependent upon the capacitance and the resistance of media sheet 18. Thus, the transfer bias voltage applied to transfer roller 54 is varied to provide optimal transfer levels for different media types. Optimization of transfer levels for given media types provides higher transfer efficiencies of developing material 61 from imaging roller 52 to media sheet 18. Further, optimization of the transfer fields also serves to retain unwanted debris, such as $CaCO_3$ and talc (magnesium silicates), upon media sheet 18 rather than having the debris accumulate upon imaging roller 52 or the fuser film surface.

Figure 6:
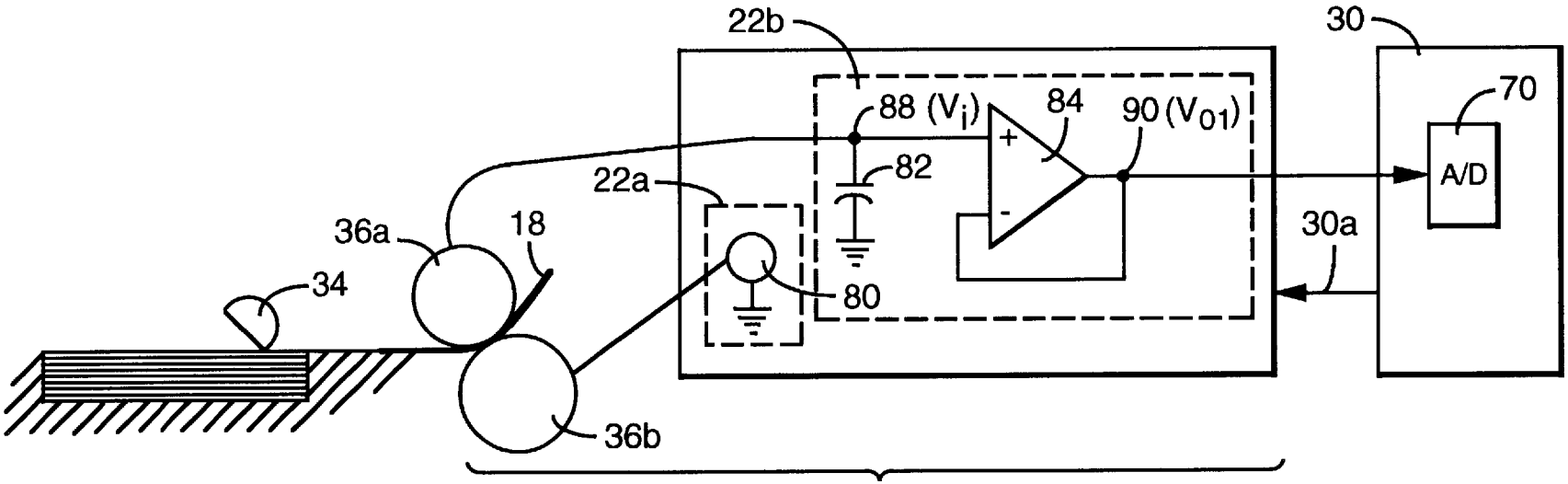
FIG. 6 depicts an exemplary sensor configuration provided upstream of the imaging assembly.

FIG. 6 is a schematic view of sensor 48, including squaring rollers 36, pulse forming circuit 22*a*, and sensing circuit 22*b* in accordance with the present invention. In some embodiments, sensor 48 may include feed rollers or other rollers in place of squaring rollers 36. Using rollers that are already a part of electrophotographic device 10 to determine the properties of the print media advantageously facilitates and lowers the cost of implementation. Squaring rollers correct the alignment of media sheet 18 to minimize media skew and transport media sheet 18 along media path 32. Media skew results in the printed image not being square to media sheet 18 and results in an aesthetically displeasing output. In contrast, feed rollers move media sheet 18 along media path 32 without correcting the alignment. Further details on squaring rollers are provided in U.S. Pat. No. 5,466,079 to Jason Quintana entitled "Apparatus for Detecting Media Leading Edge and Method for Substantially Eliminating Pick Skew in a Media Handling Subsystem," which is herein incorporated by reference.

In accordance with the present invention, the surfaces of squaring rollers 36 are made of conductive material and electrically insulated from the rest of the electrophotographic device 10. The surface of one squaring roller 36 may be made of metal (e.g., steel) while the surface of the other squaring roller 36 may be made of a conventional conductive rubber. The conductive rubber may include cast urethane or silicone, having a durometer between 45 to 55 (A-scale), and providing a contact resistance of less than 10 kΩ with a contact pressure of approximately two pounds between the metal roller and the shaft underneath the conductive rubber. A person of ordinary skill in the art would be able to obtain a suitable conductive rubber, for example from Ames Rubber in New Jersey (compound no. ARX 11832G). Conductive rubber provides mechanical compliance and a large area of electrical contact with media sheet 18. Typically, the smaller of the two squaring rollers 36, which is approximately 76 mm wide and has a diameter of 14.2 mm, maintains a 2 mm contact with the other squaring roller along the direction in which media sheet 18 travels. Thus, squaring rollers 36 provide a contact area of approximately 1.5 $cm^2$ (76 mm×2 mm) on media sheet 18 as media sheet 18 passes between squaring rollers 36. Usually, the 1.5 $cm^2$ of contact area is maintained from the time the leading edge of media sheet 18 first touches squaring rollers 36 to the time media sheet 18 has completely moved through squaring rollers 36.

As shown in FIG. 6, a first squaring roller 36*a* is electrically coupled to a pulse forming circuit 22*a*. Pulse forming circuit 22*a* includes voltage generator 80. Voltage generator 80, which receives commands from controller 30 as indicated by arrow 30*a*, is grounded to provide a reference voltage. First squaring roller 36 which is coupled to pulse forming circuit 22*a* comes in contact with a first side of media sheet 18 as media sheet 18 passes through squaring rollers 36. A second squaring roller 36*b*, which is coupled to sensing circuit 22*b*, comes in contact with a second side of media sheet 18. Sensing circuit 22*b*, as illustrated in FIG. 6, includes capacitor 82 having a capacitance C (e.g., 100 pF) and unity-gain voltage follower 84. The second squaring roller 36, capacitor 82, and the noninverting input of unity-gain voltage follower 84 all connect at input node 88. The potential at input node 88 is designated as input voltage $V_i$. The output of unity-gain voltage follower is coupled to the inverting input of unity-gain voltage follower 84 and to conditioning circuitry 70 of controller 30. In the particular embodiment of FIG. 6, the output of unity-gain voltage follower 84 is coupled to conditioning circuitry 70, which may include an A/D converter. The potential at first output node 90 is designated as first output voltage $V_{o1}$.

Figure 7:
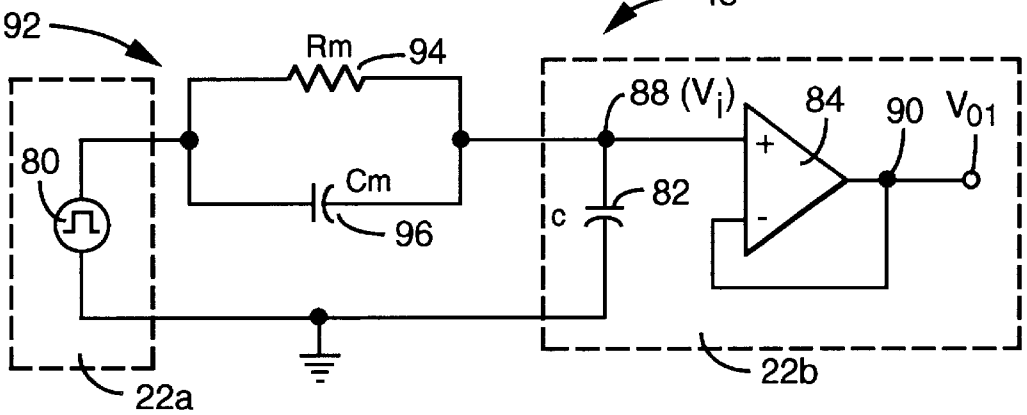
FIG. 7 depicts the circuitry of the sensor according to one embodiment of the present invention, with a media between the rollers.

FIG. 7 is a schematic view of sensor 48 wherein media sheet 18 and squaring rollers 36 are shown as equivalents to RC circuit 92. RC circuit 92 includes resistor 94 having media resistance $R_m$ and capacitor 96 having media capacitance $C_m$ arranged in parallel. Media resistance $R_m$ is affected not only by the composition (which determines resistively) of media sheet 18 but also by external factors such as temperature and humidity. Media capacitance $C_m$ depends largely on the composition and the physical dimensions of media sheet 18. Capacitor 82 may be, but is not limited to, a parallel-plate capacitor. To accurately determine the capacitance and the resistively of media sheet 18, the resistance of squaring rollers 36 should be lower, e.g., at least two orders of magnitude lower, than the lowest resistance of print media 18 ($R_m$) to be measured. RC circuit 92 and capacitor 82 form a second RC circuit. Thus, $V_i$ at input node 88 is a function of media capacitance $C_m$, media resistance $R_m$, and C.

Sensing circuit 22*b* ensures that the response of media sheet 18 to the pulses generated by voltage generator 80 can be measured accurately by creating a high-impedance input node 88 and maintaining a constant waveform across unity-gain voltage follower 84. Input voltage $V_i$ at input node 88 is difficult to measure directly under certain conditions, for example when media sheet 18 has a high resistance (e.g., 1 TΩ). For unity-gain voltage follower 84 to not influence the measurement results, the impedance of input node 88 must be at least one order of magnitude higher than media resistance $R_m$. Furthermore, due to the low charge flow at input node 88, capacitor 82 is selected to have low dielectric absorption and low leakage properties. Capacitor 82 may be, for example, a polypropylene capacitor having a capacitance of 100 pF. Similarly, the operational amplifier that constitutes unity-gain voltage follower 84, for example National Semiconductor LMC 6035, has a high input impedance. Operational amplifiers such as LMC 6035 not only maintain a high impedance but also ensure that the waveform at node 90 ($V_{o1}$) is the same as the waveform at node 88 ($V_i$). Capacitance C of capacitor 82 affects the time constant (τ), which in turn affects the rate of change of first output voltage $V_{o1}$. In the circuit of FIG. 7, the time constant τ associated with the step response is equal to the product of media resistance $R_m$ and the sum of the two capacitances ($\tau=R_m(C_m+C)$).

Figure 8:
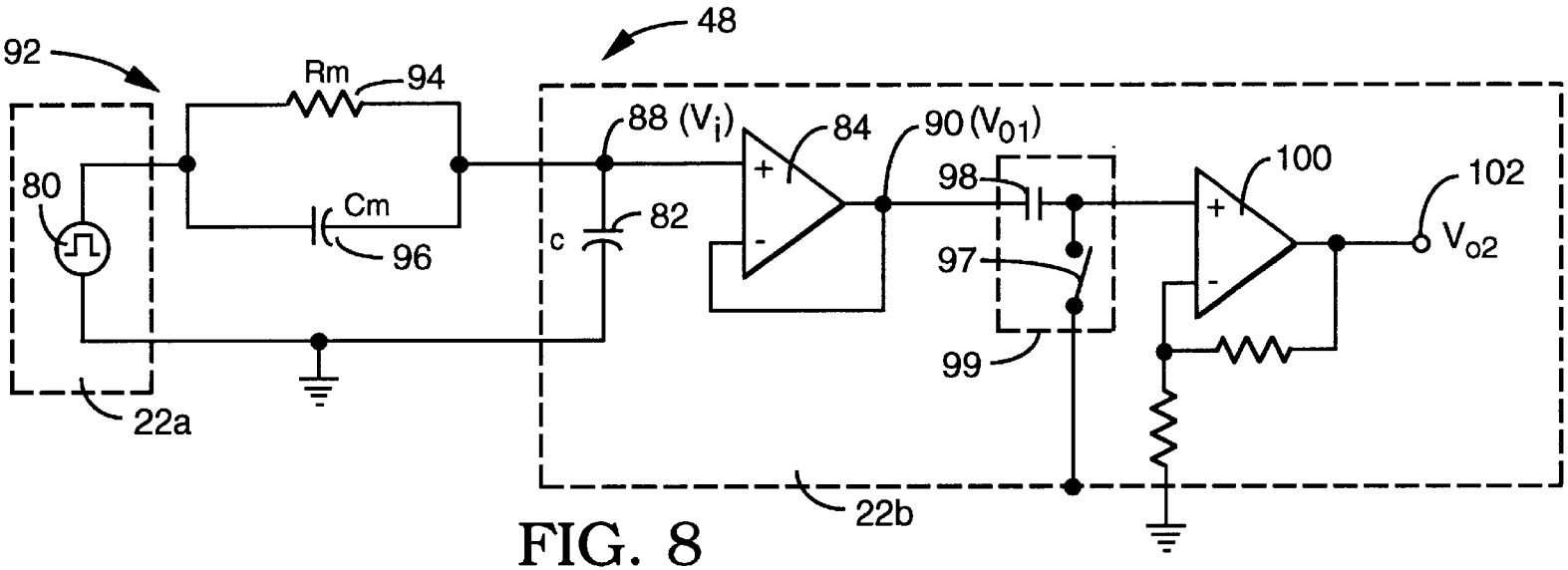
FIG. 8 depicts the circuitry of the sensor according to a second embodiment of the present invention which includes a voltage amplifier.

As shown in FIG. 6, sensor 48 is coupled to conditioning circuitry 70, which may include an analog-to-digital (A/D) converter. If the resolution provided by the A/D converter is low, determination of media resistance $R_m$ and media capacitance $C_m$ based on first output voltage $V_{o1}$ may be difficult under certain conditions. For example, determination of media resistance $R_m$ and media capacitance $C_m$ would be difficult when media resistance $R_m$ is high, in which case first output voltage $V_{o1}$ may appear substantially flat. Various methods may be used to increase the resolution of first output voltage $V_{o1}$. For example, a high-resolution A/D converter may be used. Alternatively, a voltage amplifier can be added in between unity-gain voltage follower 84 and conditioning circuitry 70. FIG. 8 shows an embodiment of the present invention using a voltage amplifier 100. In FIG. 8, the output of unity-gain voltage follower 84 is coupled to switch 99 and the noninverting input of voltage amplifier 100. Switch 99 is used to temporarily ground voltage amplifier 100 before the sampling process, which is discussed below with reference to FIG. 11. If voltage amplifier 100 has a gain of 100, a 20 mV data point at node 90 would be read as a 2V data point at second output node 102. The voltage at second output node 102 is designated as $V_{o2}$.

Figure 9:
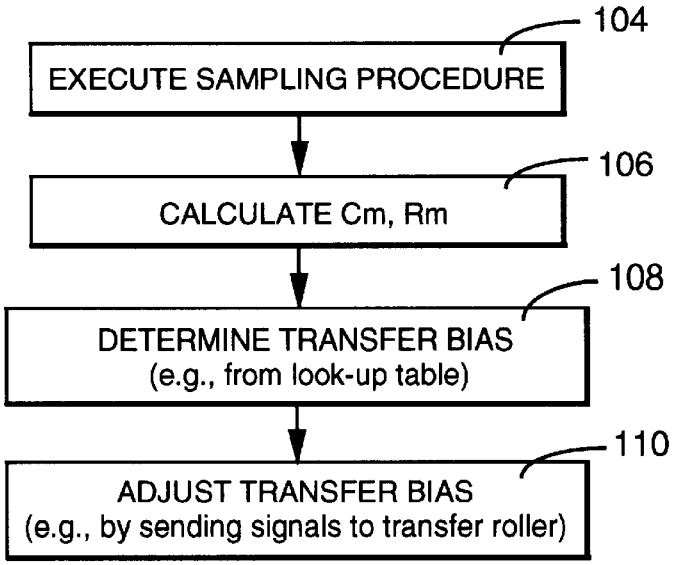
FIG. 9 depicts the exemplary operations of the controller in accordance with the present invention.

FIG. 9 shows a flowchart illustrating the operations of controller 30. In order to calculate media resistance $R_m$ and media capacitance $C_m$, controller 30 obtains datapoints by periodically sampling the output signal of sensor 48, as indicated in block 104. The output signal of sensor 48 may be first output voltage $V_{o1}$, second output voltage $V_{o2}$, or both, depending on the embodiment. In block 106, controller 30 uses the following equations to calculate media resistance $R_m$ and media capacitance $C_m$:

$$R_m=[(V_{80})(C)(\Delta t)]/[(\Delta V_{o1})(C+C_m)^2] \quad \text{equation 1}$$

$$C_m=(V')(C)/(V_{80}-V'). \quad \text{equation 2}$$

In the above equations, $V_{80}$ indicates the voltage generated by voltage generator 80 and V' indicates $V_{o1}$ immediately after the pulse rising-edge of $V_{80}$. The calculation of media capacitance $C_m$ and media resistance $R_m$ and the optimization of the image transfer process takes place between the time media sheet 18 passes through squaring rollers 36 and the time media sheet 18 reaches imager 24. The values of media resistance $R_m$ and media capacitance $C_m$ are used to determine the optimal transfer fields as indicated in block 108.

The optimal transfer bias values can be pre-derived and stored within optimization unit 73, for example in the look-up table mentioned above. System controller 72 accesses optimization unit 73 as media sheet 18 moves along media path 32. In block 110, controller 30 sends signals to transfer roller 54 and imager 24 to make adjustments based on the transfer bias obtained in block 108.

Figure 10:
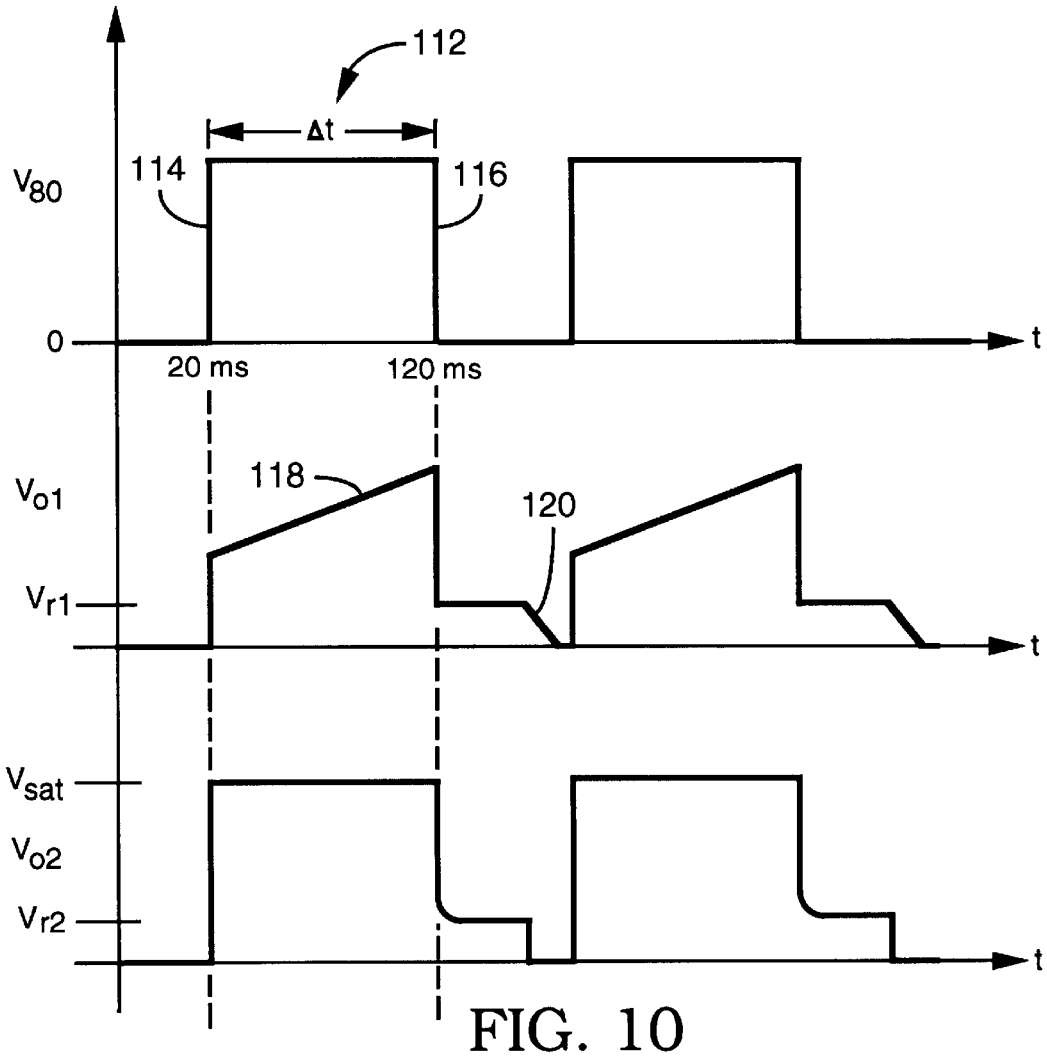
FIG. 10 depicts a typical print media response at the output of the unity-gain voltage follower and at the output of the voltage amplifier according to the present invention.

FIG. 10 shows plots of first output voltage $V_{o1}$ and second output voltage $V_{o2}$ that is measured during the sampling procedure in block 104 of FIG. 9. In FIG. 10, "$V_{80}$" indicates the voltage pulse generated by voltage generator 80. In the example, the reference voltage is, e.g., zero. Although pulse 112 is shown as a positive voltage pulse, pulse 112 may be a signal of other shape and sign. Pulse 112 begins at pulse rising-edge 114 and ends at pulse falling-edge 116. Pulse duration Δt, which is the period between pulse rising-edge 114 and pulse falling-edge 116, is 100 ms in the example. In FIG. 10, pulse rising-edge 114 occurs 20 ms into the sampling process. The 20-ms waiting period is used for pre-pulse sampling to obtain the reference voltage and to dissipate any tribocharge present on the surface of media sheet 18. The waiting period may be longer or shorter than 20 ms.

Generally, the voltage response of a RC circuit is non-linear. However, the response is substantially linear during the first 10% of the time constant τ. Thus, as long as Δt is much smaller than τ (e.g., 10% of τ), a plot of the voltage measurements during the pulse will show a substantially linear slope, shown as slope 118 in FIG. 10. Although slope 118 is shown as a positive slope in FIG. 10, it should be understood that slope 118 is not limited to being a positive slope. For example, if the voltage signal is lower than the reference voltage, slope 118 will be negative. At pulse falling-edge 116, first output voltage $V_{o1}$ falls to first residual voltage $V_{r1}$. First residual voltage $V_{r1}$ is non-zero because during the pulse period, the current has passed through $R_m$ to charge capacitor 82. In order to prevent charge buildup in unity-gain voltage follower 84, unity-gain voltage follower 84 is grounded before each pulse, as shown by the negative slope 120.

Similarly, second output voltage $V_{o2}$ may be grounded prior to a pulse. Like $V_{o1}$, second output voltage $V_{o2}$ rises in response to pulse rising-edge 114. However, unlike first output voltage $V_{o1}$, second output voltage $V_{o2}$ quickly reaches saturation voltage $V_{sat}$ and does not show a slope. The lower the media resistance $R_m$, the smaller the time constant τ is and second output voltage $V_{o2}$ reaches saturation voltage $V_{sat}$ faster. In response to pulse falling-edge 116, second output voltage $V_{o2}$ falls to second residual voltage $V_{r2}$. Second residual voltage $V_{r2}$ is equal to the product of first residual voltage $V_{r1}$ and the gain of voltage amplifier 100. Thus, even if $V_{o1}$ appears substantially flat, $V_{r1}$ can be obtained by reverse-calculation from $V_{r2}$.

Figure 11:
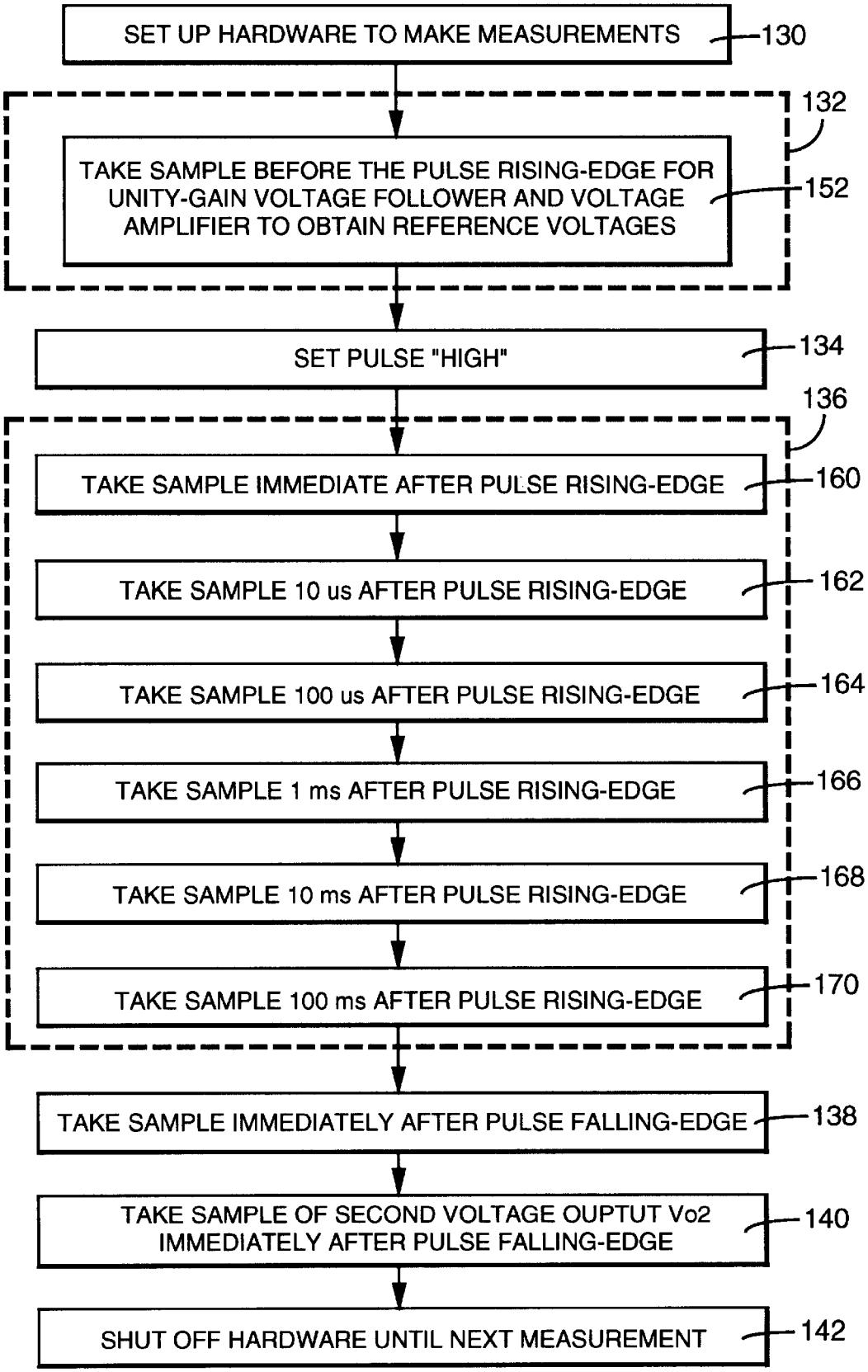
FIG. 11 depicts a flow chart of the sampling process for determining the print media properties (e.g., resistance and capacitance).

The flowchart in FIG. 11 depicts a sampling process that may be used to produce the data necessary for the calculation of media resistance $R_m$ and media capacitance $C_m$. Media resistance $R_m$ and media capacitance $C_m$ represent the response of media sheet 18 to a pulse generated by voltage generator 80. Block 130 indicates that the sampling process is initiated by a hardware set-up process. The hardware set-up process entails discharging capacitor 82 and grounding input node 88 by shorting capacitor 82. Input to voltage amplifier 100 may also be temporarily grounded during the hardware set-up process, for example by closing switch 99 of FIG. 8. Switch 99 includes switch 97 and capacitor 98. Temporarily grounding the input to voltage amplifier ensures that voltage output $V_{o2}$ accurately reflects the response of RC circuit 92 by eliminating any error that may be caused by the input offset voltage of unity-gain voltage follower 84

Blocks 132, 136, and 138 indicate that first output voltage $V_{o1}$ is sampled before, during, and after a pulse, respectively. As used herein, "before the pulse" refers to the period between the hardware setup process in block 130 and the raising of the voltage in block 134. The period "during the pulse" refers to the duration between pulse rising-edge 114 and pulse falling-edge 116 of FIG. 10. The period "after the pulse" refers to the time between pulse falling-edge 116 (FIG. 10) and the next hardware set-up process.

Block 152 indicates that at least one sample is taken before pulse-rising edge 114, for example 10 Us before pulse rising edge 114. Pre-pulse samples of first output voltage $V_{o1}$ and second output voltage $V_{o2}$ in block 132 provide the reference voltages. In block 134, after the pre-pulse samples are taken, controller 30 sends a signal to voltage generator 80 thereby setting the pulse "high" for a duration of Δt. Blocks 160, 162, 164, 166, 168, and 170 show that the samples are taken logarithmically in time during pulse 112. In other embodiments, different patterns of sampling may be used. Block 138 indicates that a sample is taken immediately after pulse falling-edge 116. Block 140 illustrates that if the particular embodiment involves voltage amplifier 100, second output voltage $V_{o2}$ may also be measured immediately after pulse falling-edge 134. After all the samples are taken for pulse 112, the hardware is shut off until the next measurement, in block 142. The values of media capacitance $C_m$ and media resistance $R_m$ can be obtained from the measured output signals.

While the present invention is illustrated with particular embodiments, it is not intended that the scope of the invention be limited to the specific features illustrated and described.

What is claimed is:

1. In a system for producing an image on a medium, an apparatus comprising:

a first roller and a second roller, wherein said medium is transported between said first roller and said second roller, said rollers and said medium forming an RC circuit; and a monitoring circuit to determine the capacitance and the resistance of said medium, said monitoring circuit coupled to said first and second rollers, said monitoring circuit comprising:

a pulse forming circuit coupled to said first roller, said pulse forming circuit applying a pulse to said medium; and a sensing circuit coupled to said second roller, said sensing circuit sensing the step response of said RC circuit.

2. The apparatus of claim 1, wherein said pulse forming circuit comprises a voltage generator.

3. The apparatus of claim 1, wherein said sensing circuit comprises:

a capacitor having a first terminal coupled to said second roller; and a first voltage follower coupled to said first terminal of said capacitor.

4. The apparatus of claim 1, wherein said first and second rollers comprise a conductive material.

5. The apparatus of claim 1, wherein said first and second rollers are squaring rollers.

6. The apparatus of claim 1, wherein said sensing circuit produces an output signal, said apparatus further comprising:

a transfer roller;

a controller comprising:

a conditioning circuit coupled to said sensing circuit, said conditioning circuit receiving said output signal of said sensing circuit and producing a conditioning signal;

a system controller circuit coupled to said conditioning circuit, said controller circuit measuring said step response of said RC circuit and calculating the capacitance and the resistance of said medium;

an optimization unit coupled to said system controller circuit, said optimization unit determining the optimal value of an imaging parameter based on said capacitance and said resistance; and a transfer bias controller for applying said optimal value of said imaging parameter to said transfer roller.

7. The apparatus of claim 6 wherein said conditioning circuit comprises an analog-to-digital converter.

8. The apparatus of claim 6 wherein said optimization unit comprises:

a look-up table containing pre-computed values of imaging parameters for specific values of capacitance and resistance.

9. The apparatus of claim 6, wherein said optimization unit comprises:

a processing unit that computes the optimal imaging parameter using the values of the capacitance and the resistance.

10. The apparatus of claim 6 wherein said transfer bias controller adjusts the transfer bias voltage.

11. The apparatus of claim 3 further comprising a voltage amplifier coupled to the output terminal of said first voltage follower.

12. A method of optimizing electrophotographic image production on a medium forming an RC circuit, said method comprising:

applying a pulse to said medium using a pulse forming circuit coupled to a first roller;

monitoring the step response of said RC circuit using a sensing circuit coupled to a second roller;

determining at least the capacitance and the resistance of said medium based on said step response; and adjusting an image parameter to produce an electrophotographic image on said medium based at least on said capacitance and resistance.

13. The method of claim 12, wherein said applying a pulse comprises providing a voltage signal when a first roller comes in contact with said medium.

14. The method of claim 13 wherein said monitoring comprises:

sensing said step response represented by said voltage signal; and measuring said step response based on said sensing.

15. The method of claim 14, further comprising transporting said medium between first and second rollers wherein said voltage is produced through said first roller and sensed through said second roller.

16. The method of claim 14, further comprising converting said sensed step response to a digital signal.

17. The method of claim 14, wherein said measuring comprises periodically sampling said step response.

18. The method of claim 14, wherein said measuring occurs before, during, and after said pulse.

19. The method of claim 12, wherein said adjusting comprises:

obtaining an optimal imaging parameter based on said capacitance and said resistance of said medium; and applying said optimal imaging parameter to a transfer roller.

20. The method of claim 19 wherein said obtaining comprises:

accessing a pre-computed value of optimal imaging parameter from a look-up table stored in a memory.

21. The method of claim 19, wherein said obtaining comprises:

computing the value of optimal imaging parameter using the values of the capacitance and the resistance.

22. The method of claim 12, wherein said imaging parameter is a transfer bias voltage.

23. The method of claim 12, wherein said adjusting comprises:

applying said imaging parameter to a transfer bias roller before or at the time said medium reaches said a transfer bias roller.

24. The method of claim 12, wherein said applying and said monitoring is achieved while said medium is stationary.

25. The method of claim 12, wherein said applying and said monitoring is achieved while said medium is moving.

* * * * *